US005285591A

United States Patent [19]

Goodwin et al.

[11] Patent Number: 5,285,591

[45] Date of Patent: Feb. 15, 1994

[54] SAFETY LEVER PIN

[75] Inventors: David H. Goodwin, Hollis; Thomas E. Charron, Saco, both of Me.

[73] Assignee: Saco Defense Inc., Saco, Me.

[21] Appl. No.: 992,417

[22] Filed: Dec. 16, 1992

[51] Int. Cl.[5] ..... F41A 17/00

[52] U.S. Cl. ..... 42/70.01; 42/70; 42/05

[58] Field of Search ..... 42/70.01, 70.02, 70.04, 42/70.05, 7

[56] References Cited

U.S. PATENT DOCUMENTS 4,133,128 1/1979 Brush ..... 42/70.01
4,414,769 11/1983 Mueschke ..... 42/70.01
4,590,697 5/1986 Ruger et al. ..... 42/70.01
4,706,401 11/1987 Nielsen ..... 42/70.01
4,967,502 11/1990 Vernon ..... 42/70.01

*Primary Examiner*—David H. Brown
*Attorney, Agent, or Firm*—William Nitkin

[57] ABSTRACT

A safety lever pin for insertion into a safety lever pin receipt aperture of the sear assembly of an MK-19 grenade launcher such pin having a machined cylindrical body with an arm extending from the top thereof and structure to retain the safety lever pin within the safety lever pin receipt aperture to prevent its inadvertent falling out therefrom when the sear assembly is removed from the weapon and inverted.

2 Claims, 3 Drawing Sheets

SAFETY LEVER PIN

BACKGROUND OF THE INVENTION

1. Field of the Invention

The device of this invention resides in the area of safety lever pins and more particularly relates to a safety lever pin for use in the sear assembly of an MK-19 grenade launcher that retains itself in place when the sear assembly is removed from the weapon.

2. Description of the Prior Art

In the structure of a 40 mm. MK-19 grenade launcher the sear assembly contains part of the safety interlock which, when the safety switch is manipulated into its safety position, prevents the bolt from moving forward, thereby preventing firing of the weapon. When the safety switch is in its firing position, the weapon can be fired. The sear assembly is removable from the weapon by rotation of the sear assembly and disengagement thereof from a bayonet-type interlock on the bottom of the weapon. Within the sear assembly is located the safety lever pin. The safety lever pin of the prior art consists of an investment cast piece having a cylindrical body with an elongated, flattened arm which extends outward from the body to retain the safety lever pin in position when inserted into its pin receipt aperture which arm prevents the pin from passing too far into the sear assembly. A narrow groove is formed in the cylindrical body at the junction with the arm. This cast piece is small and expensive to manufacture and machine. The function of the safety lever pin is to act as a pivot axis for the safety lever. This pin acts to engage and allow back and forth movement of the safety lever which can be moved back and forth into the safety position or alternately into the firing position by a thumb-operated safety switch member.

The safety lever pin is designed to be easily removed from the sear assembly when disassembling the weapon. However if the sear assembly, once removed from the weapon, is turned over, the safety lever pin has no retention means and falls out onto the ground. This occurrence can be disadvantageous if the pin cannot be located to reposition it back into the sear assembly. Because of the problem with the safety lever pin falling out of the sear assembly, it has been suggested that a drop of semi-fluid weapon's lubricant (LSAT) be inserted in the safety lever pin receipt aperture before the safety lever pin is positioned therein. The tacky consistency of the LSAT helps the safety lever pin be retained within its receipt aperture for a time. Unfortunately, such lubricants can become contaminated with dirt and will eventually lose their tackiness, allowing the safety lever pin to fall out and possibly become lost during disassembling of the weapon.

SUMMARY OF THE INVENTION

It is an object of this invention to provide an improved safety lever pin with retention means incorporated therein to replace the prior art safety lever pin which has no means of retention to prevent its accidental falling out of its receipt aperture when positioned in the sear assembly of the weapon.

It is a further object of this invention to provide a safety lever pin which is less costly to produce than the prior art device.

To accomplish the objects of this invention, the safety lever pin of this invention has cylindrical body of the same general shape and length as that of the prior art device with an arm member extending at a right angle to the body member which device is not produced by investment casting methods. The body of the safety lever pin of this invention is machined from steel rod stock so that it is less costly to produce than the prior art pin which requires investment casting of the body member with the arm member integral therewith. In the safety lever pin of this invention a cylindrical aperture is drilled at one end of the body member into which a small, hollow, longitudinally split tube is inserted and is frictionally retained therein by the outward pressure of the sides of the tube adjacent to the split so that the tube cannot easily be removed from the aperture. This small, hollow split tube acts as an arm and prevents the body of the safety lever pin from entering too far into its receipt aperture of the sear assembly. In order to retain the safety lever pin of this invention within the safety lever pin receipt aperture, a spring-loaded ball member is positioned and retained in a chamber formed at the lower end of the cylindrical body of the safety lever pin. This spring-loaded ball member has a spring member at its rear which, when the safety lever pin is positioned in the safety lever pin receipt aperture, urges the ball outward against the side wall of the safety lever pin receipt aperture. Portions of the body member above and below the entrance of the ball's chamber are staked, causing such staked portions of the body to be forced over portions of the chamber's entrance such that the wider portion of the ball nearer its diameter, is too wide to pass beyond the staked sections of the body member, thereby retaining most of the ball member within the chamber. The ball is urged outward by its spring member such that a portion of the ball protrudes from the entrance of the chamber beyond the side of the body member. Since the diameter of the body member of the safety lever pin is slightly smaller than the diameter of the safety lever pin receipt aperture, the pin fits snugly within the safety lever pin receipt aperture. The ball member, being spring-loaded, presses hard against the wall around the safety lever pin receipt aperture and by such pressure retains the safety lever pin in place in the safety lever pin receipt aperture, thereby eliminating the problem encountered in the prior art of the safety lever pin inadvertently falling out of its receipt aperture when the sear assembly is inverted. The safety lever pin of this invention can be removed by first pushing the pin from the bottom until the arm has risen out of its receipt aperture and then lifting it out of the sear assembly.

DESCRIPTION OF THE PREFERRED EMBODIMENT(S)

Figure 2:
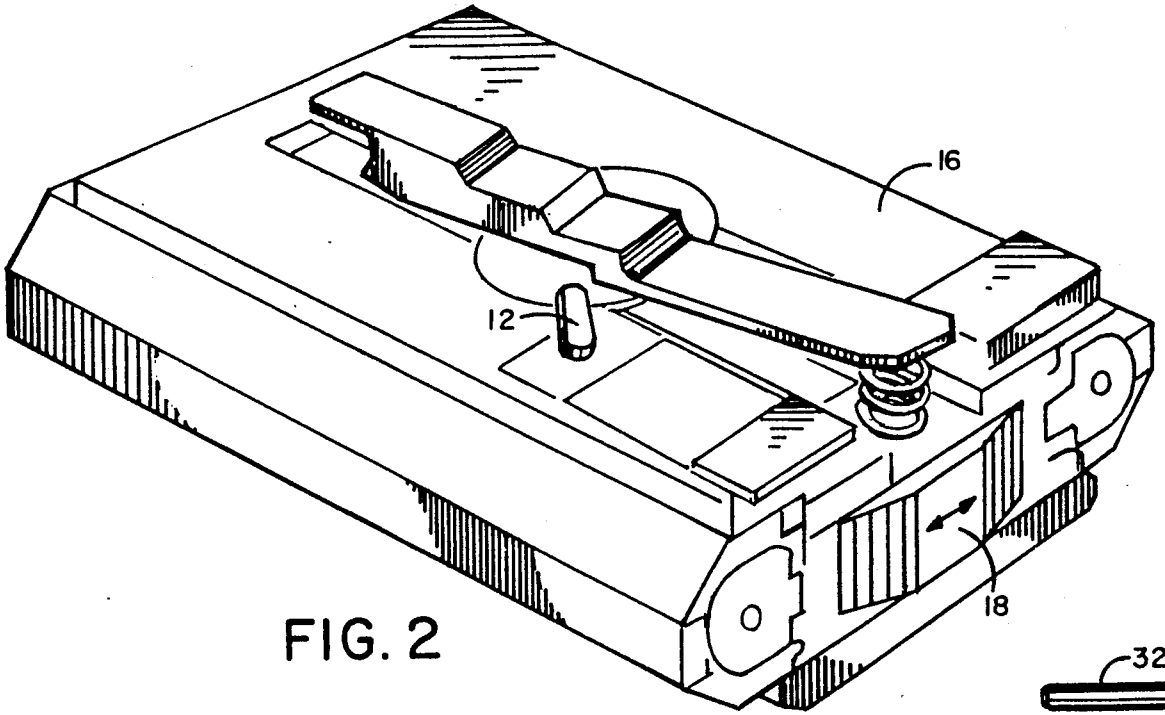
FIG. 2 illustrates a perspective view of a sear assembly showing the general position of the safety lever pin with its upper arm seen while the pin portion extends downward into the sear assembly forming the pivot axis for the safety lever.
Figure 6:
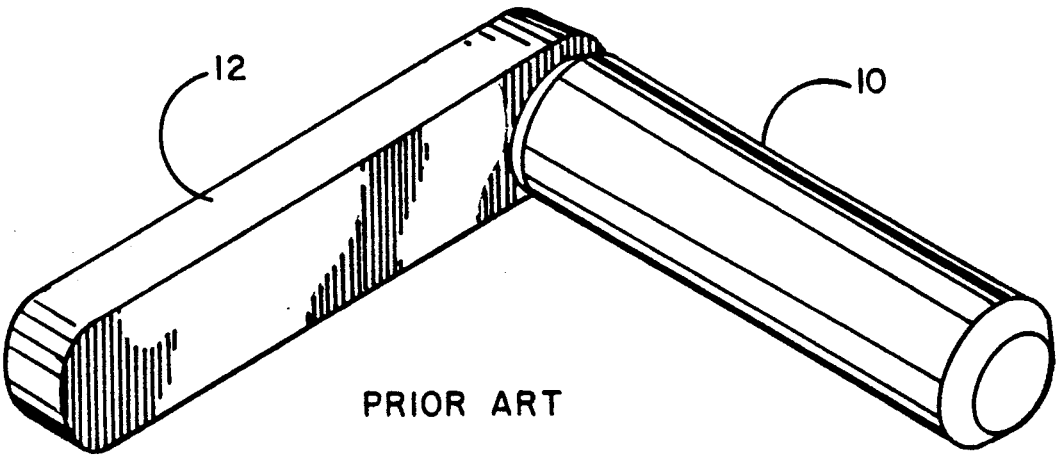
FIG. 6 illustrates the safety lever pin of the prior art.

FIG. 6 illustrates the safety lever pin of the prior art which has a body 10 and arm 12 both of which are first cast by the investment cast method and then machined to precise tolerances. The prior art safety lever pin, as mentioned above, has several disadvantages. The prior art safety lever pin is not only costly to produce, but also, and far more importantly, it has no means to retain itself in its receipt aperture in the sear assembly. If the sear assembly, as seen in FIG. 2, is inverted after it is removed from the weapon, the safety lever pin of the prior art falls out of its receipt aperture onto the ground. If such pin is not located and repositioned in its receipt aperture, the weapon cannot be properly reassembled.

Figure 1:
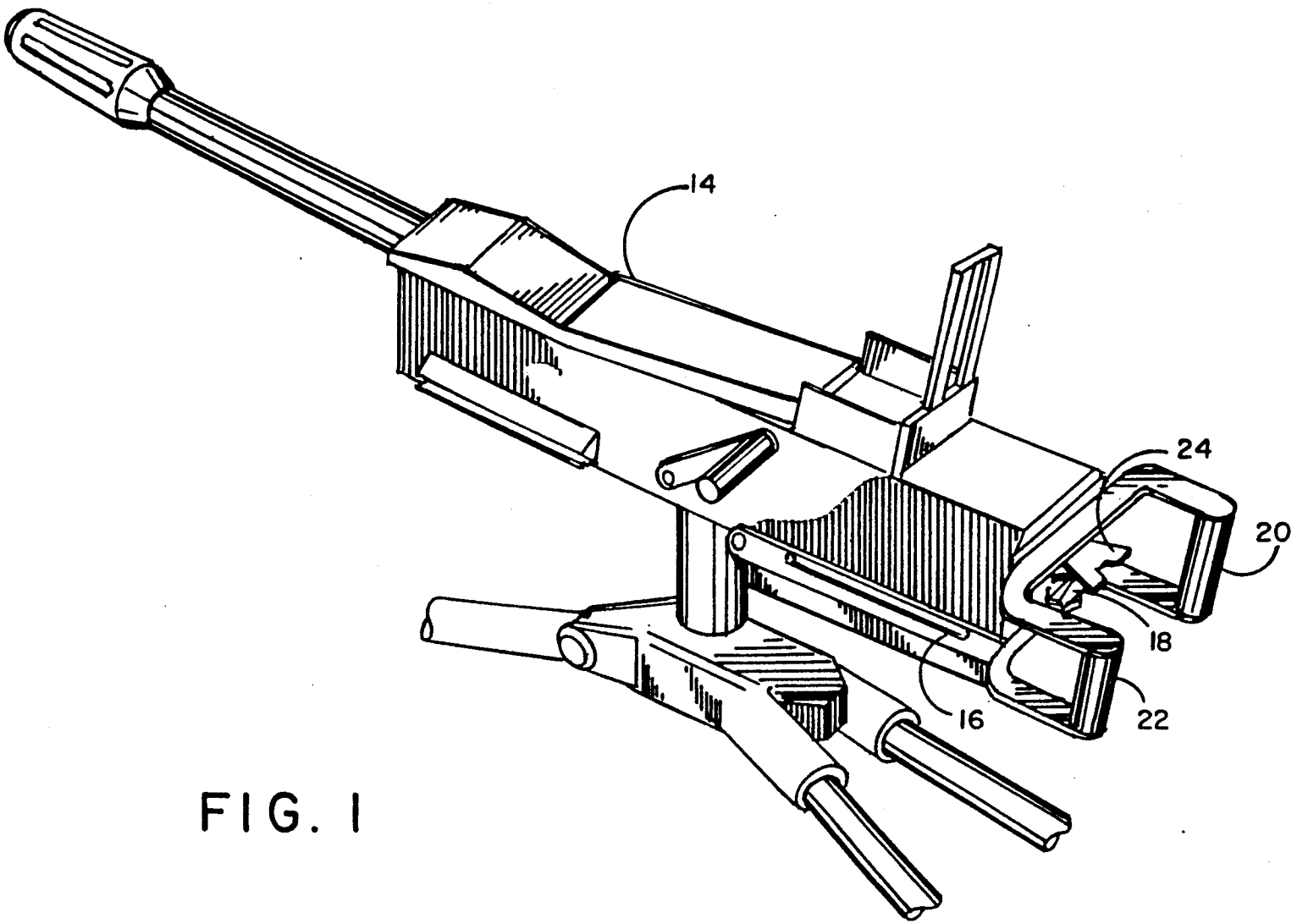
FIG. 1 illustrates an overall perspective view of an MK-19 grenade launcher showing the sear assembly positioned at the bottom thereof with a safety switch at the rear of the weapon.

FIG. 1 illustrates a perspective view of an MK-19 weapon 14 at the bottom of which is located sear assembly 16 having at its rear safety lever switch 18 which is easily reached by the operator of the weapon when holding dual handles 20 and 22. Also easily reached is trigger mechanism 24 which can be pushed downward to fire the weapon. When it is desired to engage the safety lever, the operator can easily reach and slideably move safety lever switch 18 which, when moved to the right, engages the safety mechanism and when slid to the left, allows the weapon to fire.

Figure 3:
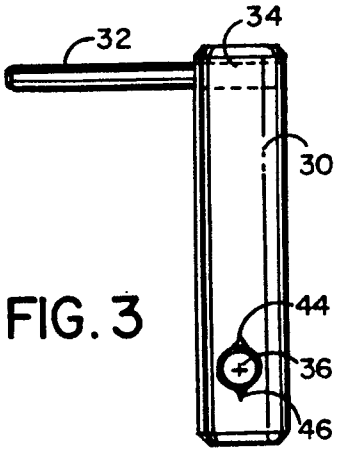
FIG. 3 illustrates a side elevational view of the safety lever pin of this invention.
Figure 4:
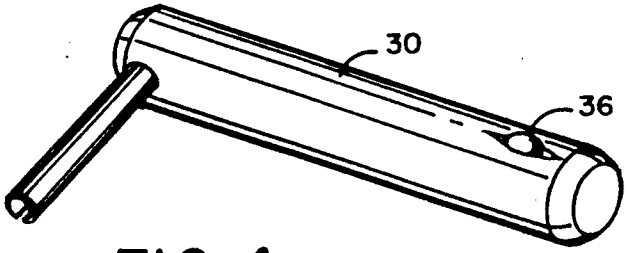
FIG. 4 illustrates a perspective view of the safety lever pin of this invention.
Figure 5:
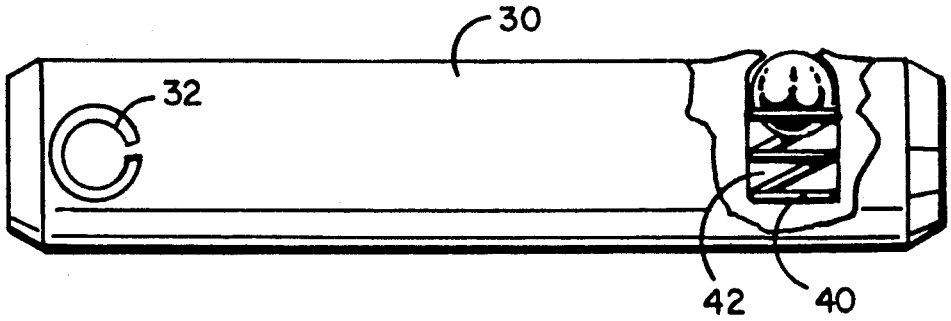
FIG. 5 illustrates a side view of the safety lever pin of this invention with a portion cut away to show the ball member and spring member in the ball member chamber.

FIG. 3 illustrates a side elevational view of the device of this invention having its cylindrical body 30 made of corrosion-resistant steel of a length of approximately 0.812 inch. The cylindrical body is machined, with any sharp edges broken off, to a diameter of approximately 0.187 inch to allow its insertion into the safety lever pin receipt aperture of the sear assembly. The top and bottom edges are cut away at an angle of approximately 15 degrees to ease insertion of the safety lever pin into the safety lever pin receipt aperture. By using steel rod stock to produce the cylindrical body of the safety lever pin of this invention and not casting the safety lever pin as done in the prior art, significant savings are obtained in production cost. The device of this invention functions as well as that of the prior art but has the added advantage of being self-retained within the safety pin receipt aperture. An arm 32, being approximately 0.531 inch long, is formed of a hollow metal tubing having a longitudinal split defined therein. This tubing is compressed along its length and friction-fitted within arm receipt aperture 34 defined in body 30 of the safety lever pin of this invention. The length of arm 32 does not need to be as long as the length of the cast arm of the prior art since one of its purposes is to prevent body 30 from advancing too far down the safety lever pin receipt aperture. The other purpose is to prevent disassembly by any upward movement of the pin as a part of the weapon is located immediately above the arm which prevents the arm from rising upwards. The split defined in the tubing of arm 30 allows the sides of arm 32 which are adjacent to the split to urge outward to help retain arm 32 in arm receipt aperture 34. Near the bottom of the safety lever pin and at the side of body member 30 is ball member 36. Ball member 36 protrudes from body 30 as seen in the perspective view of FIG. 4. The ball member is staked into chamber 42 so that the diameter of the ball is below the outer surface of body 30. The ball is urged to its outermost position by spring member 40, as seen in the cutaway side view of FIG. 5. Spring member 40 is located within chamber 42 cut into body 30. In a preferred embodiment spring member 40 can be made of wire having a diameter of 0.018 inch and have 4.5 coils with a total height of approximately 0.092 inch. The load of spring member 40 at compression can be approximately 36 lbs. The diameter of the spring member can be approximately 0.070 inch. Chamber 42 can be approximately 0.140 inch deep and 0.081 inch in diameter. Ball 36 can be approximately 0.078 inch in diameter and be made of corrosion resistant steel. The ball member is staked in position by forcing portions of body 30 over opposite sides of the entrance of chamber 42 as a result of the staking process such as seen by staked portions 44 and 46 in FIG. 3. These staked portions are portions of body member 30 forced over the entrance of chamber 42 and these portions constrict the opening of chamber 42 such that ball 36 is prevented from fully emerging from chamber 42 but yet is urged outward against the staked portions by spring member 40. Ball 36 protrudes from the side of body member 30 as seen in FIG. 4. Ball 36 protrudes approximately to a point to form a total width of ball protrusion with the diameter of body member 30 of approximately 0.204 inch which protrusion is sufficient to allow the safety lever pin to be pushed into the pin receipt aperture within the sear assembly and also to be retained therein even if the sear assembly is inverted. The safety lever pin can be deliberately removed by manually lifting up on arm 32.

Although the present invention has been described with reference to particular embodiments, it will be apparent to those skilled in the art that variations and modifications can be substituted therefor without departing from the principles and spirit of the invention.

We claim:

1. An improved safety lever pin for insertion into a safety lever pin receipt aperture defined in the sear assembly of an MK-19 grenade launcher, said receipt aperture having a side wall, comprising:

a cylindrical body member having a top, a bottom and side, the production of said body member characterized by not being cast;

an arm extending outward from the side of said body member near the top thereof;

means incorporated within said body member to retain said safety lever pin within said safety lever pin receipt aperture during inversion of said sear assembly including:

a ball receipt chamber, cylindrical in shape, defined in the side of said body member near its bottom, said chamber having an entrance;

spring means located within said chamber;

a ball member movably positioned within said chamber above said spring means, said spring means adapted to urge said ball member outward; and means to retain said ball member partially within said chamber, said ball member protruding from the entrance of said chamber, causing said ball member to extend beyond said side wall of said body member and urging outward against the side of said safety lever pin receipt aperture to retain said safety lever pin in place within said safety lever pin receipt aperture.

2. The safety lever pin of claim 1 wherein:

the arm of said safety lever pin is comprised of a longitudinally split, hollow tubular member; and an arm receipt aperture defined in the side of said body member near its top, said tubular member being compressed along its length and inserted within said arm receipt aperture and securely retained.

* * * * *